US008075713B2

(12) United States Patent
Renkel

(10) Patent No.: US 8,075,713 B2
(45) Date of Patent: Dec. 13, 2011

(54) METHOD FOR PRODUCTION OF PRECISION CASTINGS BY CENTRIFUGAL CASTING

(76) Inventor: Manfred Renkel, Bad Staffelstein (DE)

( * ) Notice: Subject to any disclaimer, the term of this patent is extended or adjusted under 35 U.S.C. 154(b) by 110 days.

(21) Appl. No.: 12/450,702

(22) PCT Filed: Apr. 11, 2007

(86) PCT No.: PCT/EP2007/003228

§ 371 (c)(1),
(2), (4) Date: Dec. 4, 2009

(87) PCT Pub. No.: WO2008/125129

PCT Pub. Date: Oct. 23, 2008

(65) Prior Publication Data

US 2010/0089500 A1 Apr. 15, 2010

(51) Int. Cl.
*C22F 1/18* (2006.01)
*B22D 13/00* (2006.01)

(52) U.S. Cl. ..... 148/539; 148/669; 164/114

(58) Field of Classification Search ..... None
See application file for complete search history.

(56) References Cited

U.S. PATENT DOCUMENTS

| | | | |
|---|---|---|---|
| 5,284,620 | A | 2/1994 | Larsen, Jr. |
| 5,634,992 | A | 6/1997 | Kelly et al. |
| 5,950,706 | A | 9/1999 | Choudhury et al. |
| 6,231,699 | B1 | 5/2001 | Kelly et al. |
| 2004/0060685 | A1 | 4/2004 | Ray et al. |

OTHER PUBLICATIONS

Metals Handbook, Desk Edition, (1985), pp. 28-65 to 28-66.*

* cited by examiner

*Primary Examiner* — George Wyszomierski
(74) *Attorney, Agent, or Firm* — Manabu Kanesaka

(57) ABSTRACT

A production of precision castings by centrifugal casting, includes the following steps: a) providing in a crucible (8) a melt of the following composition: $Ti_{45\text{-}52\ at.\ \%}Al_{45\text{-}50\ at.\ \%}X1_{1\text{-}3\ at.\ \%}X2_{2\text{-}4\ at.\ \%}X3_{0\text{-}1\ at.\ \%/}$ where X1=Cr, Mn, V, X2=Nb, Ta, W, Mo, X3=Si, B, C; b) forcing the melt by means of centrifugal forces from the crucible (8) into a mold (4); c) solidifying the melt within the mold thereby creating a casting consisting of a titanium alloy having a lamellar microstructure; and d) reheating the casting for a duration of 60 to 150 hours at a temperature higher than the eutectic temperature and lower than the alpha-transus temperature of the composition.

20 Claims, 4 Drawing Sheets

METHOD FOR PRODUCTION OF PRECISION CASTINGS BY CENTRIFUGAL CASTING

The invention pertains to a method for production of precision castings by centrifugal casting. The method in particular pertains to the production of precision castings made of titanium or alloys containing large amounts of titanium, e.g. titanium aluminides.

Especially titanium aluminides are considered an optimum material in various areas of application because of their low density, relatively high-temperature, specific strength relative to nickel superalloys, and corrosion resistance. However, materials with a narrow range between solidus and liquidus temperature, like TiAl or pure titanium grade 2, are very difficult to shape, the only practical method for forming them is to cast them.

A melt consisting of a TiAl alloy has the narrow range between solidus and liquidus temperature of around 5° C. Because of that such a melt has to forced rapidly into a mold, e.g. by centrifugal casting. In particular when producing thin walled castings, like shrouded turbine blades or turbo charger wheels, the melt solidifies rapidly when it hits the inner wall of the mold. The strength of TiAl alloy castings produced by centrifugal casting is lower than the strength of a comparable TiAl alloy part produced by another method.

U.S. Pat. No. 6,231,699 B1 discloses a method of producing a gamma titanium aluminide alloy article. In order to reduce the porosity of the article it is proposed to consolidate the article by hot isostatic pressing. Further, it is proposed to heat treat the article afterwards at a temperature below the alpha transus temperature in order to refine the microstructure.

U.S. Pat. No. 5,634,992 discloses a method of producing a gamma titanium alloy article. The method starts from a piece of cast gamma titanium aluminide alloy which is consolidated at a temperature above the eutectoid to reduce porosity therein. The consolidation of the gamma titanium aluminium alloy piece is performed by hot isostatic pressing. Afterwards the consolidated article is heat treated at a temperature from about 1150° C. to 1200° C. for a time of at least 8 hours. Thereafter the article is again heat treated at a temperature from about 980° C. to 1100° C. for a time of about 8 hours in order to reduce the effective grain size of a colony structure.

Both aforementioned methods start from a solidified piece of gamma titanium aluminide. For purposes of consolidation said piece has to be heated up to temperature above the eutectoid. Further, a isostatic pressure has to be exerted upon the heated up piece. The proposed consolidation step starting from a solidified piece of a gamma titanium aluminide requires the provision of a hot isostatic pressing equipment and is therefore costly and time consuming. Besides that hot isostatic pressing frequently causes an undesirable deformation of the casting due to an uneven distribution of pores being included within the material. Such an unpredictable deformation is not tolerable in particular when producing e.g. turbine blades for aircraft. Further, hot isostatic pressing causes local cracks in the lamellar microstructure. Such cracks have a negative import on the strength of the material.

An object of the present invention is it to avoid the disadvantages in the art. It is an aim of the present invention to provide a method allowing a production of castings made of a TiAl alloy and having an improved strength. A further aim of the present invention is to provide a method by which castings having a complicated geometry can be produced without strain induced damages.

This object is solved by the features of claim 1. Advantageous embodiments of the invention are described by the features of claims 2 to 18.

In accordance with the present invention there is provided a method for production of precision castings by centrifugal castings, comprising the following steps:

a) providing in a crucible a melt of the following composition:

$$Ti_{45\text{-}52\ at.\ \%}Al_{45\text{-}50\ at.\ \%}X1_{1\text{-}3\ at.\ \%}X2_{2\text{-}4\ at.\ \%}X3_{0\text{-}1\ at.\ \%},$$

where

X1=Cr, Mn, V

X2=Nb, Ta, W, Mo

X3=Si, B, C;

b) forcing the melt by means of centrifugal forces from the crucible into a mold;

c) solidifying the melt within the mold thereby creating a casting consisting of a titanium alloy having a lamellar microstructure; and d) reheating the casting for a duration of 60 to 150 hours at a temperature being higher than the eutectic temperature and lower than the alpha-transus temperature of the composition.

In the sense of the present invention under a "crucible" there is in general understood a container which has sufficient heat resistance to take up the melt without being damaged and without undergoing reactions with the melt. A "crucible" in the sense of the present invention may have any suitable shape. In particular it may have a cylindrical shape the bottom of which has a rounded concave shape. However, a "crucible" in the sense of the present invention may also be formed as a ring-like channel. Suitable materials for the production of a crucible are alumina, $Y_2O_3$, magnesia, silica glass, graphite and the like.

With respect to an explanation and possibilities of a determination of the "alpha-transus temperature" reference is made to U.S. Pat. No. 6,231,699 B1. The alpha-transus temperature is typically in the range of 1,350° C. An upper temperature limit during step d) may therefore be fixed for example at a temperature of 1250° C. or 1150° C.

By use of the proposed composition and a centrifugal casting method with steps b) and c) there can be produced a casting consisting of fine crystals having an average diameter in the range of 30 to 100 pm, wherein each grain exhibits a fully lamellar microstructure.

In contrast to what is known in the art it has surprisingly been found that by reheating the casting for a duration of 60 to 150 hours at a temperature being higher than the eutectic temperature and being lower than the alpha-transus temperature of the composition the strength of the casting can be improved remarkably. Further, machining of the casting is remarkably improved by step d). Moreover, it was surprisingly observed that the brittle-ductile transition temperature (BDTT) is lowered from around 1050° C. to 950° C. when reheating the casting in accordance with step d). It has to be noted that by step d) the lamellar microstructure is preserved. In particular there is not formed a duplex microstructure. It is assumed that by step d) strain being frozen within the microstructure is reduced.

For example, the titanium alloy may contain 30 to 45 wt. % Al, 1.5 to 6 wt. % Nb and as balance Ti as well as unavoidable impurities. The titanium alloy may further contain one or more of the further constituents: 0.5 to 3.0 wt. % Mn, 0.1 to 0.5 wt. % B, 1.5 to 3.5 wt. % Cr. Further, the titanium alloy may contain $O_2$ in an amount of 0 to 1400 ppm, C in an amount of 0 to 1000 ppm, preferably 800 to 1200 ppm, Ni in an amount of 100 to 1000 ppm and N in an amount of 0 to 1000 ppm.

According to a further embodiment of the invention, the melt is heated up during step a) to a temperature which is 50° C. to 150° C. higher than the melting temperature of the composition. By this measure the thermal energy of the melt is increased. When using such a superheated melt in particular an undesirable formation of cold runs in molds for castings having thick walled sections, i.e. sections with a thickness in the range of 0.5 mm, can be avoided.

According to a further advantageous feature, the mold is pre-heated before step b). The temperature of said preheating may be in the range of 50° C. to 1100° C., preferably in the range of 100° C. to 850° C. Such a preheating temperature is in particular useful when producing turbine blades. For example for the production of turbo charger wheels it has been proofed to be advantageous to use a temperature for said preheating in the range of 50° C. to 500° C. — It has to be understood that the preheating temperature of the mold depends from the geometry of the casting and the heat capacity of the melt and has to be determined for each geometry. Further, the heating preheating temperature also depends from the heat capacity of the melt and has to be determined for each heat capacity.

The preheating of the mold may take place for example in a furnace from which the mold is transferred into a rotor of a centrifugal casting device before a centrifugal casting takes place. However, it is also possible to preheat the mold by a suitable heating device being provided at the centrifugal casting device, in particular at the rotor. By preheating the mold an undesirable quenching of the melt being forced into the mold can be avoided. Surface quality of the casting can be improved.

According to a further embodiment the casting is cooled down to a temperature below 150° C. after step c) and before d), preferably, at a cooling-rate of 50° C. to 500° C. per hour. A high cooling-rate can be achieved simply by cooling down the casting at ambient temperature conditions. A low cooling-rate can be realized by the use of molds having suitable thermal isolation properties. Molds without suitable thermal isolation properties may be placed in a furnace which is preheated upon a temperature which is in the range of the predetermined cooling-temperature. After transferring the mold into the furnace it may be cooled down by controlling the heating elements of the furnace so that the aforementioned cooling-rate is realized within the furnace. The proposed controlled cooling down of the mold also counteracts the formation of hot tears in the casting.

According to a further embodiment of the invention during steps a) to c) the melt is under vacuum or shield gas. In particular the use of vacuum is advantageous as therewith a formation of gas-filled pores and an oxidation of titan aluminides can be avoided. It has been proven appropriate to use a vacuum of $10^{-1}$ to $10^{-3}$ bar in order to avoid the formation of in particular gas-filled pores.

According to a further embodiment at step d) the temperature for reheating is in the range from 1000° C. to 1250° C., preferably in the range of 1050° C. to 1150° C. Advantageously reheating may take place in an atmosphere which is essentially free of oxygen. The casting may in particular be reheated under a shield-gas, preferably under an argon-atmosphere or under vacuum. By the aforementioned measure an undesirable oxidation of the casting is avoided.

According to a further advantageous embodiment during step c) a pressure may be exerted on the melt until the temperature of the solidifying melt has reached a predetermined cooling-temperature in a range of 1300° C. to 800° C., wherein the pressure corresponds to the centrifugal force acting on the melt at the moment when the mold is completely filled times a factor of 1.0 to 5.0 and wherein the pressure is relieved when the temperature of the solidifying melt is lower than that predetermined cooling-temperature.

The proposed method differs from conventional method in particular in that there is exerted a pressure on the melt after the mold has completely been filled.—The pressure is exerted on the melt until a predetermined cooling-temperature in a range of 1300° C. to 800° C. has been reached. The predetermined cooling-temperature depends on the used metal alloy. The predetermined cooling-temperature is advantageously selected to be lower than a brittle-ductile transition temperature of the used alloy. Under the term "brittle-ductile transition temperature" there is understood a temperature at which the bonds of an intermetallic phase change from metal bonds to atomic bonds. At temperatures above the brittle-ductile transition temperature intermetallic phases are bond by metal bonds. At such temperatures intermetallic phases are superplastic. At a temperature below the brittle-ductile transition temperature intermetallic phases change their properties and become brittle. The predetermined cooling-temperature can be chosen to be for example 20° C. to 200° C. lower than the brittle-ductile transition temperature.

The amount of the pressure which is exerted on the melt after the mold is completely filled corresponds to the centrifugal force acting on the melt at the moment when the mold is completely filled times a factor of 1.0 to 5.0.

The centrifugal force depends for example from the rotational speed of a rotor, the first radius at which the mold is distanced from the axis and the mass of the melt. Under the term "first radius" there is understood the distance between the axis and an inlet opening of the mold. The pressure to be exerted on the melt may correspond to the centrifugal force at the precise moment of completely filling of the mold times a factor which is selected from a range of 1.0 to 5.0. From this relation one can calculate a suitable pressure to be exerted on the melt for molds being placed at a different first radius from the axis as well as for any mass of metal melt which is taken up in the mold. As can be seen from the above relation the pressure being exerted upon the melt after the mold is completely filled may be higher than during the time when the mold is being filled.

According to a further advantageous feature the predetermined cooling-temperature is in a range of 1050° C. to 800° C. Predetermined cooling-temperatures selected from this range are usually lower than the brittle-ductile transition temperature of titanium aluminides. When choosing a cooling-temperature from the proposed range and exerting a pressure upon the melt until the chosen predetermined cooling-temperature is reached castings made of titanium aluminides can be produced with an excellent quality.

According to an embodiment the pressure may be increased after the mold has been filled, preferably at a constant rate, for a predetermined period and afterwards there may be exerted a constant pressure on the melt. The predetermined period may be in the range of 1 to 25 seconds, preferably 5 to 20 seconds. The period of the constant pressure may be in range of 1 to 6 minutes, preferably of 4 to 6 minutes.

By the proposed exerting of a pressure on the solidifying melt being hotter than the predetermined cooling-temperature a formation of pores, voids, shrinkholes and the like in the castings can be significantly reduced. It is in particular not necessary to reprocess the casting by high-pressure compaction. A particular advantage is that a formation of strain induced damages can be avoided even when producing castings with a complicated geometry, like shrouded turbine blades and vane clusters.

According to an embodiment of the invention the crucible is accommodated in the rotor at a second radial distance from the axis, the second radial distance being smaller than the first radial distance. The second radial distance may be calculated from an outlet opening of the crucible to the axis. Usually, the second radial distance is larger than a diameter of the crucible. If the crucible and the associated mold are both accommodated eccentrically with respect to the axis of the rotor it is possible to create higher centrifugal forces acting upon the melt at comparable rotating speeds. Thereby the mold can rapidly be filled and the formation of cold runs can be avoided. This further improves the quality of the casting in that less pores, voids or shrinkholes are created.

It is possible to create the melt in the crucible while the rotor is standing, i.e. while the rotor is not rotating. In this case the melt can be created by inductively heating an ingot within the crucible. It is also possible to heat the ingot or to support the heating of the ingot by microwaves. By the proposed heating methods an ingot can be melt within several minutes.

The pressure can be exerted upon the melt in different manners. According to a simple embodiment the pressure is exerted upon the melt by rotating the rotor. In this case the pressure is created by centrifugal forces acting upon the melt. However, it is also possible to exert the pressure upon melt for example by pressurised gas. In this case as gas there may be used preferably an inert gas like Argon or the like.

According to an advantageous embodiment the melt may be poured into the crucible while the rotor is rotating. By this measure the melt being poured into the crucible can be accelerated rapidly and can be forced with a high speed into the mold. Consequently, the mold is filled with the melt being at a relatively high temperature which in turn guaranties a certain mobility of the melt and therefore the pressure being exerted upon the melt during step c) can effectively be used to cold runs and to reduce pores.

It has been proven appropriate that the crucible has the form of a ring-shaped channel being centrally accommodated in the rotor, the outer circumference of which having a second radial distance from the axis, the second distance being smaller than the first radial distance. According to this feature the melt is poured into a ring-shaped channel at a radial distance with respect to the axis. Consequently, the centrifugal force acting upon the melt and therefore the velocity by which the melt is transferred into the mold can be increased by this measure.

Embodiments of the invention are now described in detail with reference to the accompanied figures.

Figure 3A:
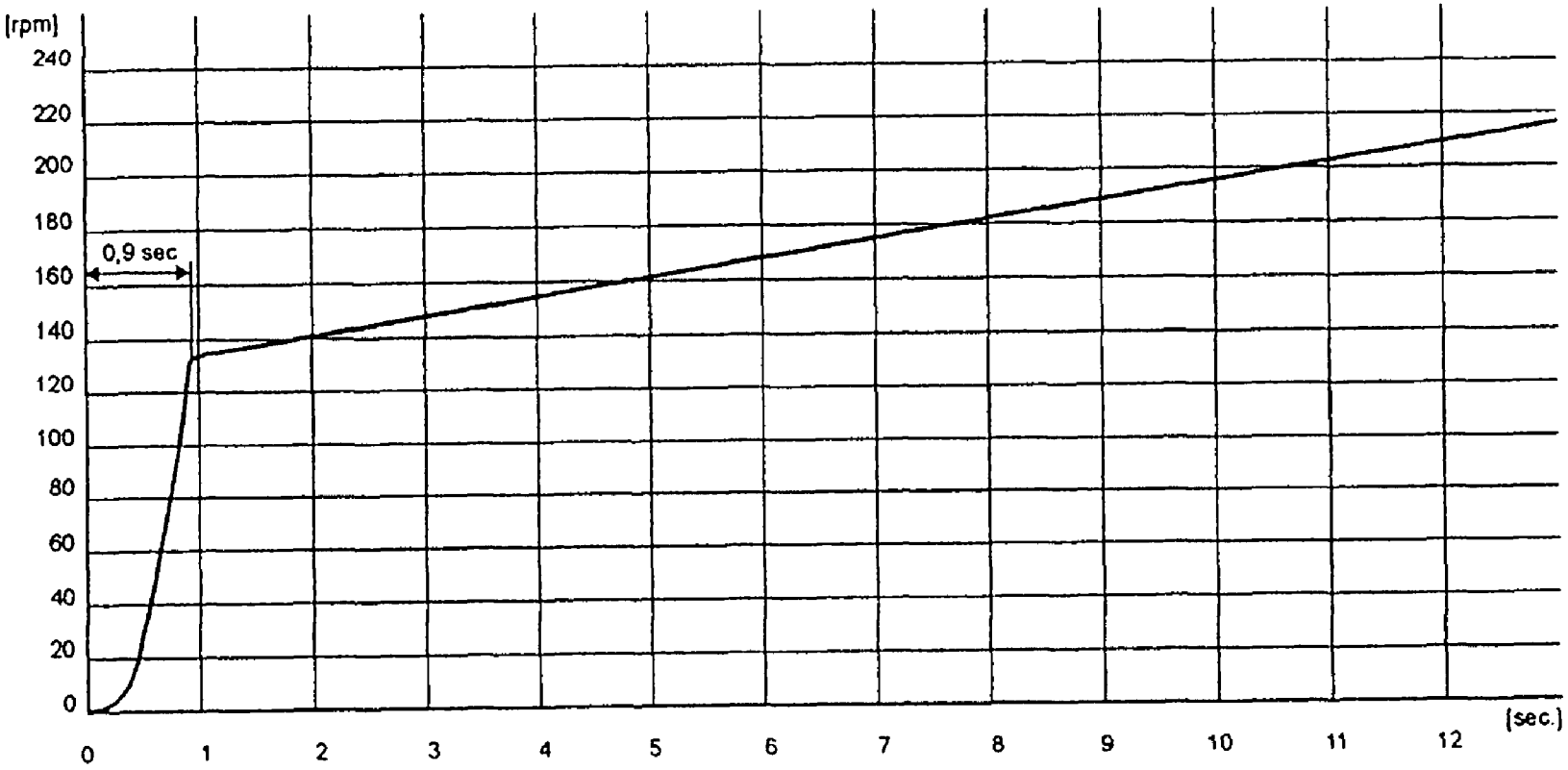
Figure 3B:
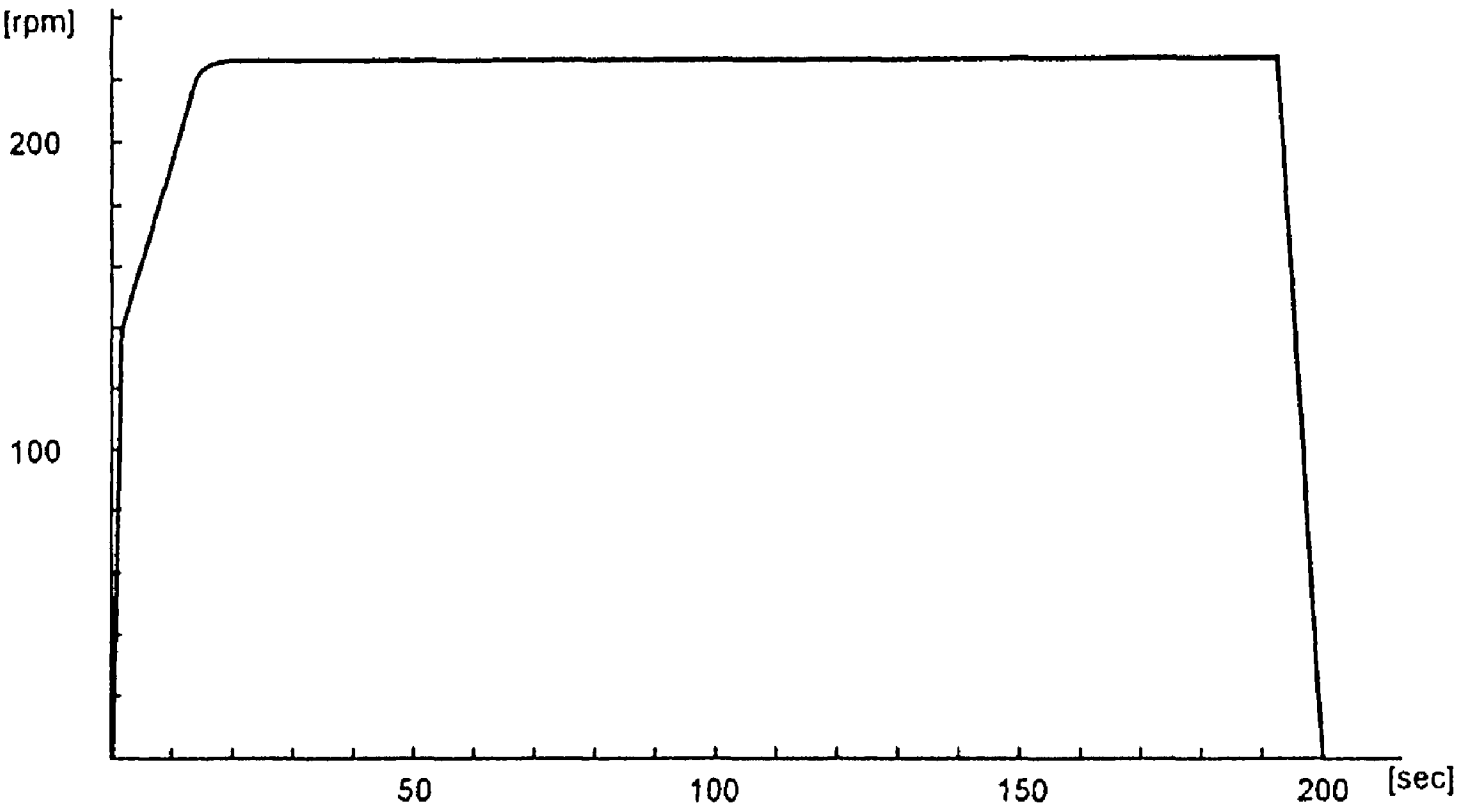

FIG. 3*a* shows a first plot of the rotational speed of a rotor over the time and FIG. 3*b* shows a second plot of the rotational speed of a rotor over the time.

Figure 1:
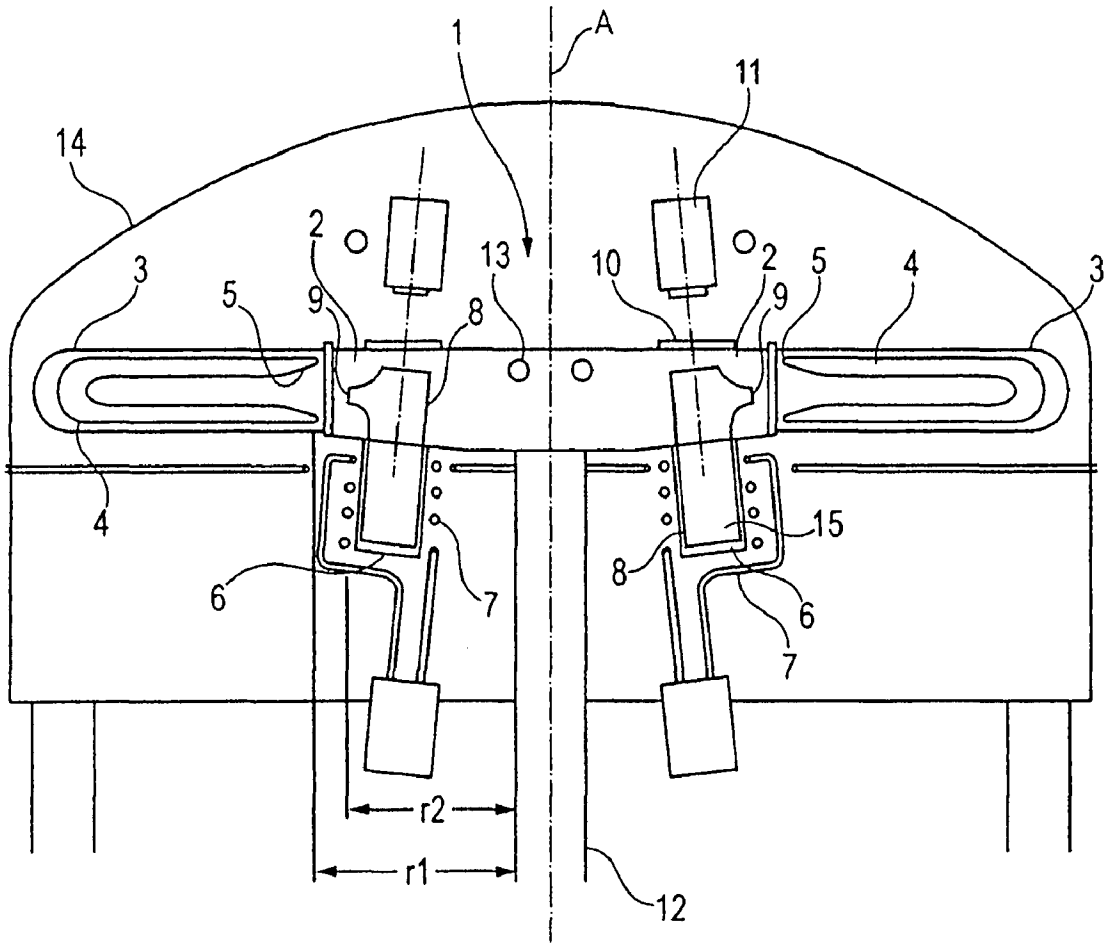
FIG. 1 shows a sectional drawing of a first device.

FIG. 1 shows a rotor 1 which is rotatable around an axis A. The rotor 1 comprises two hollow tube-like arms 2. At the outer end of each arm 2 there is releasably mounted, preferably in a gas-tight manner, a piston 3. In the piston 3 there is accommodated a mold 4 having a funnel-like inlet opening 5 which is directed to the axis A.

Nearby the outer end of each arm 2 there is provided a first crucible 6 made of a heat resistant material, e.g. silica glass or the like. The first crucible 6 is mounted at a bottom of the arm 2, preferably in a gas-tight manner.

The first crucible 6 is surrounded by an induction-coil 7 which can be moved in an essentially vertical direction. In an lower position (not shown here) of the induction-coil 7 it does not surround the first crucible 6 so that the first crucible 6 can be rotated with the rotor 1 around the axis A. Within the first crucible 6 there is accommodated a second crucible 8 having a outlet opening 9 which is placed opposite to the inlet opening 5 of the mold 4.

The second crucible 8 is made of a heat-resistant material, e.g. alumina, $Y_2O_3$, graphite or the like. According to a preferred embodiment of the invention the second crucible 8 is made of alumina, magnesia or the like. There may be provided a third crucible (not shown here) made of graphite which may be placed within the second crucible 8. By the use of the third crucible an inductive melting of an ingot taken up therein can be accelerated.

Opposite to a bottom of the second crucible 8 there is provided a window 10 through which by means of a camera 11 the melting of the ingot may be observed.

A hollow shaft 12 extending vertically from the rotor 1 may be driven by an electric motor (not shown here).

In an embodiment of the invention there is provided a vacuum source, e.g. a vacuum pump or the like, which is connected by means of a conventional sealing with the hollow shaft 12 to create within the rotor 1, which is designed in this case in a gas-tight manner, a vacuum.

In a second embodiment of the invention the rotor 1 may have breakthroughs 13. The rotor 1 may be surrounded by a gas-tight housing 14. The vacuum source may be connected to the gas-tight housing 14 to create therein and thereby also within the rotor 1 a vacuum.

In another embodiment of the invention there is provided instead of a vacuum source a source of a shield gas, e.g. Ar or the like, by which the hollow structure surrounded by the rotor 1 may be flooded during the centrifugal casting process.

As can be seen from FIG. 1 the mold is accommodated within the rotor 1 at a first radial distance rl and the second crucible 8 taking up a melt 15 is accommodated within the arm 2 at a second radial distance r2. Under the first radial distance there is understood a distance between then inlet opening 5 and the axis A; under the second radial distance there is understood the distance between the outlet opening 5 and the axis A. As can be seen from FIG. 1 the first radial distance is larger than the second radial distance. Further, the second crucible has a cylindrical shape and the second radius is larger than the diameter of the crucible, i.e. the second crucible 8 is located eccentrically with respect to the axis A within the rotor 1.

It has to be understood that the rotor 1 may comprise more than two arms 2, e.g. 4, 6, 8 or more arms. The rotor 1 may also be disk-shaped.

According to a further embodiment within the rotor 1 there may also be accommodated a first and a second crucible which are formed like ring-channels. These ring like channels again may be made for example of a heat-resistant ceramic like silica-glass, alumina, graphite and the like. One or more ingots taken up in the second crucible, which is formed as a ring-channel, may be again heated by an induction-coil, which surrounds an inner and an outer diameter of the first crucible, which is as well formed like a ring-channel and which accommodates the second ring-channel like crucible.

The second ring-channel like crucible may have several outlet openings. Vis-à-vis each outlet opening there is accommodated in a radial direction a corresponding mold with their inlet opening.

Figure 2:
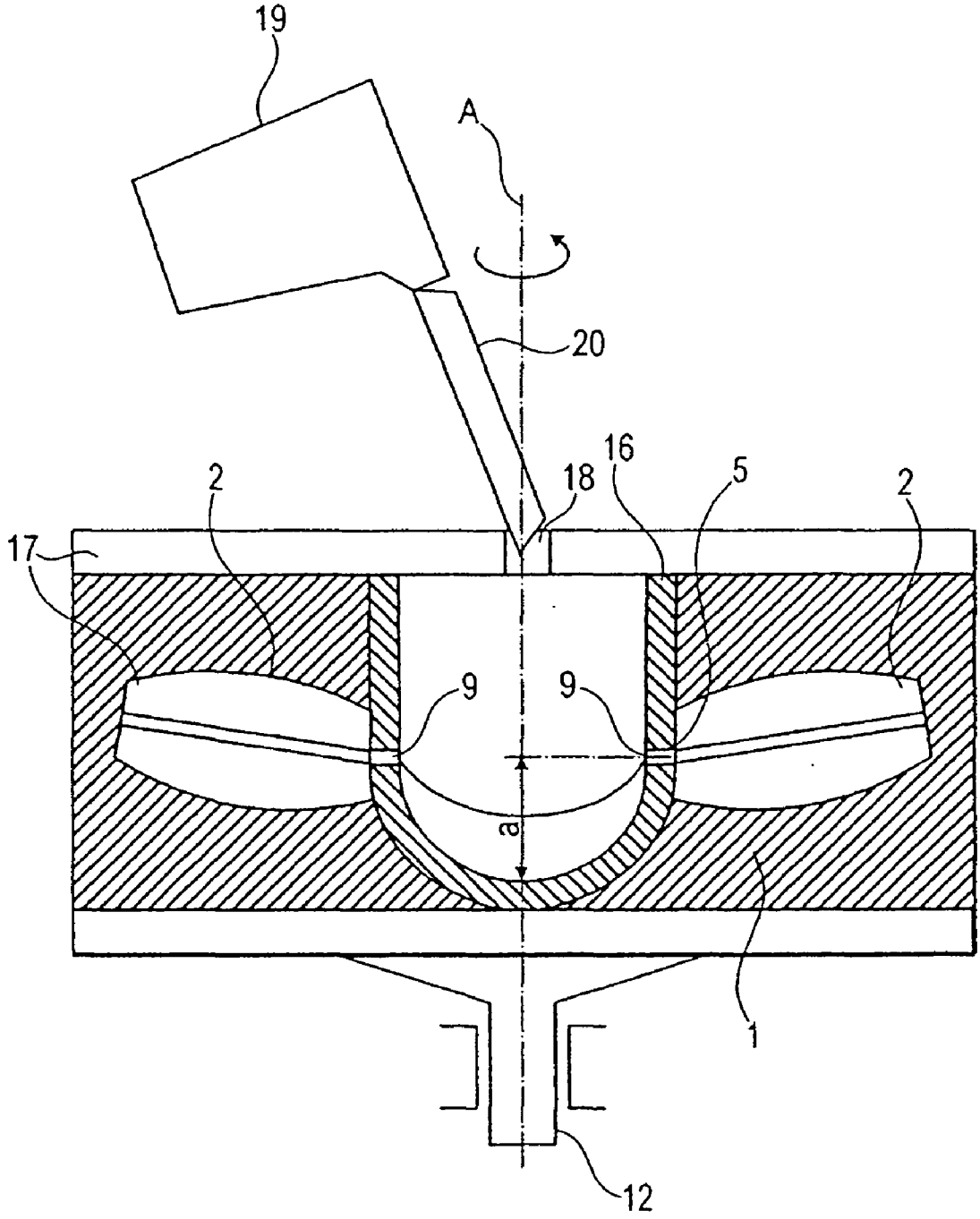
FIG. 2 shows a sectional drawing of a second device.

FIG. 2 shows a second device in the rotor 1 of which there is centrically accommodated a fourth crucible 16, which may be made of alumina, $Y_2O_3$ or the like. Vis-à-vis second openings 9 of the fourth crucible 16 there are provided molds 2 with their inlet openings 5 being located vis-à-vis the outlet openings 9. The inlet openings 5 are arranged again in a first radial distance r1 from the axis A.

The fourth crucible 16 is arranged centrically with respect to the axis A. A lid 17 having a centrically arranged opening 18 covers the fourth crucible 16. A fifth crucible 19 may be connected via a tube 20 with the opening 18 so that a melt can be poured from the fifth crucible 19 through the opening 18 into the fourth crucible 16.

By using the first device a precision casting may be produced as follows:

A titanium aluminide ingot is placed in the second crucible 8. The respective titanium aluminide alloy may have e.g. one of the following compositions:

a) 31 wt. % Al, 5 wt. % Nb, 1.5 wt. % Mn, 0.3 wt. % B and as balance Ti as well as unavoidable impurities;

b) 43 wt. % Al, 2 wt. % Nb and as balance Ti as well as unavoidable impurities;

c)33 wt. % Al, 5 wt. % Nb, 2.5 wt. % Cr and as balance Ti as well as unavoidable impurities.

A mold which may be made of a ceramic being lined at there interior contact surface with $Y_2O_3$ is preheated in a furnace up to a temperature of 200° C. to 1000° C. Suitable materials for the production of a mold are for example disclosed in the WO 2005/039803 A2.

The mold 4 which may be preheated to a temperature of 200° C. to 1000° C. is mounted at the arm 2 and then covered with the piston 3 which is mounted in a gas-tight manner at the arm 2. In dependency on the number of arms 2 provided at the rotor 1 a multitude of molds 4 can be mounted at the rotor 1. Afterwards there is created a vacuum within the arm in the range of $10^{-1}$ to $10^{-3}$ bar.

The ingot is then melt by inducing currents with the induction-coil 7. When the melt has reached a temperature in the range of 1400° C. to 1700° C., preferably in the range of 1450° C. to 1650° C., the rotor 1 is accelerated within 0.5 to 2.0 seconds, preferably within less than 1.0 second, upon rotational speed of 110 to 260 rpm, preferably with 100 to 160 rpm. The second radius r2 is in this case chosen to be 300 to 400 mm, preferably around 350 mm. The melt is forced by centrifugal forces from the second crucible 8 into the mold 4.

Afterwards the mold 4 has been filled with melt the rotor 1 is advantageously furtheron rotated at a rotational speed of 110 to 260 rpm, preferably of at least 160 rpm, for at least 60 seconds, preferably for 120 to 300 seconds. During the further rotation of the rotor 1 the rotational speed may be increased at a constant rate, e.g. from initial rotational speed selected from a range of 110 to 160 rpm to a rotational speed selected from a range of 180 to 260 rpm when the solidifying melt in the mold 4 has reached predetermined cooling-temperature in the range of 1300° C. to 850° C.

As soon as the predetermined cooling-temperature has been reached the rotation is stopped. The casting may be then further cooled down under vacuum for 5 to 50 minutes, preferably 5 to 15 minutes, until it reaches a temperature in the range of 400° C. to 600° C., preferably 480° C. to 530° C.

The temperature of the solidifying melt in the mold 4 may be determined by conventional temperature measuring techniques using for example a thermocouple. The temperature values measured therewith may be corrected in accordance with a suitable algorithm in a conventional manner.

Afterwards the mold 4 is demounted from the arm 2. The mold 4 may be further cooled down under ambient temperature conditions. Alternatively the mold 4 may be placed in the furnace which is preheated on a temperature of around 1000° C. The mold 4 may then be cooled down within the furnace with a rate of 50° C. to 100° C. per hour.

At step a) the melt can be created within the crucible by heating up ingots of the respective composition. However, it is also possible to pour a melt of the respective composition into the crucible.

According to the above embodiment the rotor 1 is evacuated before melting the ingot within the second crucible 8. The vacuum within the rotor 1 may be in the range of $10^{-1}$ to $10^{-3}$ bar. Alternatively the rotor 1 may be flooded with shield gas, for example Ar before melting the ingot.

By use of the second device precision castings by centrifugal casting can be produced as follows:

Molds 4 may be preheated in a similar manner as described above in a furnace up to a temperature of 1000° C. and then placed in suitable holding devices provided within the rotor 1.

The rotor 1 is accelerated upon a rotational speed in the range of 110 to 260 rpm. As soon as the melt has reached a predetermined temperature in the range of 1450° C. to 1650° C. the melt taken up in the fifth crucible 19 is poured into the fourth crucible 16. The melt is than forced through the outlet openings 9 provided at the fourth crucible 16 in the molds 4 which are located vis-à-vis.

Afterwards, the rotor 1 is furtheron rotated as described above. After stopping the rotation the molds 4 are demounted from the rotor 1 and cooled down as described above.

FIGS. 3*a* and 3*b* show plots of the rotational speed of the rotor above the time. In FIG. 3*a* the acceleration of the rotor during the first 12 seconds from the beginning of the rotation is showed. FIG. 3*b* shows a rotational speed of the rotor from the beginning of the rotation until the rotation is stopped.

When using the first device an ingot is melt within the second crucible 8. As soon as predetermined temperature of the melt has been reached the rotor 1 is accelerated within less then one second up to a rotational speed of around 140 rpm. Observations have shown that the melt is completely forced into the mold one second after starting the rotation of the rotor 1. As can be seen from FIG. 3*a* it is preferred to increase the rotational speed of the rotor 1 after the first second from around 140 rpm with a constant rate of 200 to 280 $rpm^2$, preferably with a rate of 240 $rpm^2$, so that around 14 seconds after the beginning of the rotation a rotational speed of around 220 to 240 rpm has been reached. When reaching the predetermined maximum rotational speed in the range of 200 to 250 rpm the rotor is furtheron rotated at a constant rotational speed. As can be seen from FIG. 3*b* this rotational speed may be in the range of 220 to 240 rpm, in particular around 225 rpm. Around 220 to 240 seconds after the beginning of the rotation of the rotor 1 the rotation is stopped.

When using the second device shown in FIG. 2 the melt is poured from the fifth crucible 19 into the fourth crucible 16 for example around 0.5 to 1.0 seconds after the rotation of the rotor 1 has been started, e.g. at a moment when the rotor rotates with a speed of around 140 rpm. Then the rotational speed the rotor 1 may be increased as shown in FIG. 3*a* at a constant rate until the rotor 1 has reached a rotational speed in the range of 200 to 240 rpm. Then the rotor 1 may be rotated at a constant speed in the range of 200 to 250 rpm for around two to four minutes.

Afterwards the casting which may be advantageously taken up in the mold, is reheated in an essentially oxygen free atmosphere, e. g. under an argon-atmosphere. The reheating is preferably done at a heating rate of 50 to 200° C., preferably 80 to 120° C. The reheating step lasts 60 to 150 hours, preferably more than 60 hours. It has been turned out to be advantageous to reheat the casting at step d) for a time in the range of 70 to 130 hours, preferably 80 to 110 hours, most preferably around 100 hours. The reheating temperature is in the range of 1000° C. to 1150° C., preferably around 1050° C.

After the reheating step the casting is cooled down to room temperature with a cooling rate which may be in the range of 50° C. to 200° C. per hour.

By the proposed reheating step surprisingly the strength of the casting can be remarkably increased. Further, machining of the casting can be improved.

The following table gives a comparison between results of the ultimate tension strength (UTS) and the Ultimate Strain (E) of samples "as cast", i.e. without being reheated and of samples "HT", i.e. being reheated in accordance with step d) in dependency of the temperature:

| | as cast | | HT | |
|---|---|---|---|---|
| Temperature | UTS | E | UTS | E |
| 900° C. | 309 Mpa | 0.2% | 419 MPa | 0.8% |
| 950° C. | — | — | 367 MPa | 1.2% |
| 1000° C. | 273 Mpa | 1.3% | 320 MPa | 2.1% |
| 1100° C. | 188 MPa | 15.8% | 185 MPa | 28.0% |

As can be seen from the above table by the proposed heat treatment in accordance with step d) the strength at temperatures between 900° C. and 1000° C. can remarkable be improved. At temperatures above 1000° C. the strength of the samples decreases obviously because the BDTT (Brittle-Ductile Transition Temperature) is exceeded.

It is assumed that the increase in strength results from a decrease in internal stress which is caused by the reheating step d). Furthermore, from the above results it seems that the BDTT (Brittle-Ductile Transition Temperature) is also lowered by the proposed reheating in accordance with step d).

The invention claimed is:

1. A method for production of precision castings by centrifugal casting, comprising:

a) providing in a crucible a titanium alloy melt of the following composition:

$$Ti_{45\text{-}52\ at.\ \%}Al_{45\text{-}50\ at.\ \%}X1_{1\text{-}3\ at.\ \%}X2_{2\text{-}4\ at.\ \%}X3_{0\text{-}1\ at.\ \%},$$

where

X1=Cr, Mn, V,

X2=Nb, Ta, W, Mo,

X3=Si, B, C;

b) forcing the titanium alloy melt by means of centrifugal forces from the crucible into a mold;

c) solidifying the titanium alloy melt within the mold thereby creating a titanium alloy casting having a lamellar microstructure; and d) reheating the titanium alloy casting for a duration of 80 to 150 hours at a temperature higher than the eutectic temperature and lower than the alpha-transus temperature of the titanium alloy casting.

2. The method of claim 1, wherein the titanium alloy melt contains one or more of 0.5 to 3.0 wt. % Mn, 0.1 to 0.5 wt. % B, and 1.5 to 3.5 wt. % Cr.

3. The method of claim 1, wherein the titanium alloy casting contains $O_2$ in an amount of 0 to 1000 ppm, C in an amount of 0 to 1400 ppm, Ni in an amount of 100 to 1000 ppm and N in an amount of 0 to 1000 ppm.

4. The method of claim 1, wherein at step a) the titanium alloy melt is heated up to a temperature which is 50° to 150° C. higher that the melting-temperature of the titanium alloy.

5. The method of claim 1, wherein the mold is preheated before step b).

6. The method of claim 5, wherein the temperature of preheating is in the range of 50 to 1000° C.

7. The method of claim 5, wherein the temperature of preheating is in the range of 100° C. to 850° C.

8. The method of claim 1, wherein the casting is cooled down to a temperature below 150° C. after step c) and before step d), at a cooling-rate of 50° C. to 500° C. per hour.

9. The method of claim 1, wherein during steps a) to c) the titanium alloy melt is under vacuum or shield gas.

10. The method of claim 1, wherein at step d) the temperature for reheating is in the range from 1000° C. to 1250° C.

11. The method of claim 1, wherein the titanium alloy casting is reheated in an atmosphere which is essentially free of oxygen.

12. The method of claim 1, wherein the titanium alloy casting is reheated under a shield-gas, or under vacuum.

13. The method of claim 1, wherein during step c) a pressure is exerted on the titanium alloy melt until the temperature of the titanium alloy melt, in liquid form, has reached a predetermined cooling-temperature in a range of 1300° to 800° C., whereat the pressure corresponds to the centrifugal force acting on the titanium alloy melt at the moment when the mold is completely filled times a factor of 1.0 to 5.0, and wherein the pressure is relieved when the temperature of the titanium alloy melt is lower than said predetermined cooling-temperature thereby solidifying the titanium alloy melt.

14. The method of claim 13, wherein the predetermined cooling-temperature is in a range of 1050° C. to 800° C.

15. The method of claim 13, wherein the pressure exerted on the melt is a constant or an increasing pressure.

16. The method of claim 13, wherein the pressure is exerted on the melt for 1 to 6 minutes.

17. The method of claim 13, wherein the pressure is exerted on the melt by rotating a rotor of a centrifugal casting device around an axis, wherein the crucible is accommodated in the rotor and the mold is associated with said crucible and accommodated in a first radial distance (r1) from the axis.

18. The method of claim 17, wherein the rotor is rotated with the same or an increasing speed during step c).

19. The method of claim 1, wherein the titanium alloy casting contains $0_2$ in an amount of 0 to 1000 ppm, C in an amount of 800 to 1200 ppm, Ni in an amount of 100 to 1000 ppm and N in an amount of 0 to 1000 ppm.

20. The method of claim 1, wherein at step d) the temperature for reheating is in the range from 1050° C. to 1150° C.

* * * * *